US008266756B1

(12) United States Patent
Kovarik

(10) Patent No.: US 8,266,756 B1
(45) Date of Patent: Sep. 18, 2012

(54) SCRUBBER ADAPTED FOR CLEANING A SIDE FACE AND UNDER SURFACE OF LAP SIDING

(76) Inventor: Andrew C. Kovarik, Edwardsville, IL (US)

( * ) Notice: Subject to any disclaimer, the term of this patent is extended or adjusted under 35 U.S.C. 154(b) by 149 days.

(21) Appl. No.: 12/909,670

(22) Filed: Oct. 21, 2010

Related U.S. Application Data

(63) Continuation-in-part of application No. 12/143,013, filed on Jun. 20, 2008, now abandoned.

(60) Provisional application No. 61/253,689, filed on Oct. 21, 2009.

(51) Int. Cl.
*A47L 13/16* (2006.01)

(52) U.S. Cl. ..... 15/210.1; 15/144.2; 15/228; 15/244.1; 15/244.2

(58) Field of Classification Search ..... 15/144.1, 15/144.2, 160, 209.1, 210.1, 228, 231, 244.1–244.4, 15/247; D4/137; D32/40, 51, 52
See application file for complete search history.

(56) References Cited

U.S. PATENT DOCUMENTS

| | | | | |
|---|---|---|---|---|
| 531,433 | A | | 12/1894 | Brooks |
| 608,365 | A | | 8/1898 | Goehring |
| 1,284,992 | A | | 11/1918 | Belknap |
| 2,042,546 | A | | 6/1936 | Meier |
| 3,214,779 | A | * | 11/1965 | Wheeler ..... 15/244.2 |
| 3,346,900 | A | | 10/1967 | Stewart et al. |
| 3,761,990 | A | | 10/1973 | Lynn |
| 4,114,223 | A | | 9/1978 | Buchanan |
| 4,255,827 | A | | 3/1981 | Palazzo |
| 4,455,705 | A | * | 6/1984 | Graham ..... 15/121 |
| 4,554,699 | A | | 11/1985 | Simmons |
| 4,580,307 | A | * | 4/1986 | Moss ..... 15/147.1 |
| 5,177,831 | A | | 1/1993 | Wirth |
| 5,419,015 | A | * | 5/1995 | Garcia ..... 15/228 |
| 5,634,232 | A | | 6/1997 | Brenneman |
| D417,324 | S | * | 11/1999 | Farls ..... D32/40 |
| D433,819 | S | | 11/2000 | Thunderchild |
| 6,199,241 | B1 | | 3/2001 | Anumah |
| 6,772,466 | B2 | | 8/2004 | Ziegler |
| 2004/0064909 | A1 | | 4/2004 | Locklear |
| 2006/0099025 | A1 | | 5/2006 | Hann |
| 2006/0117510 | A1 | | 6/2006 | Sellers |
| 2007/0061987 | A1 | | 3/2007 | Kresse et al. |

FOREIGN PATENT DOCUMENTS

| | | |
|---|---|---|
| CA | 2210880 | 8/1996 |
| JP | 200444282 | 2/2004 |

* cited by examiner

*Primary Examiner* — Mark Spisich
(74) *Attorney, Agent, or Firm* — Grace J. Fishel

(57) ABSTRACT

A scrubber for lap siding with a profile complementary to the profile of the boards in the lap siding such that when the scrubber is moved side to side in a washing action, an exposed side face and under surface of the siding boards are effectively scrubbed and dirt, dust, mildew, mold and algae are effectively removed.

15 Claims, 8 Drawing Sheets

SCRUBBER ADAPTED FOR CLEANING A SIDE FACE AND UNDER SURFACE OF LAP SIDING

This application is a continuation-in-part of U.S. application Ser. No. 12/143,013, filed Jun. 20, 2008, now abandoned, for Scrubber Adapted for Cleaning a Side Face and an Under Surface Of Lap Siding and claims priority from U.S. provisional application Ser. No. 61/253,689, filed Oct. 21, 2009, for Scrubber for Scrubbing Siding.

BACKGROUND OF THE INVENTION

1. Field of the Invention

The present invention relates to a scrubber for washing the exposed side face and the under surface of lap siding. By "under surface" is meant the bottom edge surface of an overlapping board or siding extrusion panel.

2. Brief Description of the Prior Art

Lap siding, also known as clapboard, bevel siding or weather-board (with regional variants as to the exact definitions of these terms), is a board or extrusion panel typically used for exterior horizontal siding that sometimes has one edge thicker than the other where the board above laps over the one below (or, in the case of vinyl siding extrusions, appears to lap over the board below). The siding is a weather barrier to the exterior walls of a frame home, building or structure. In newer construction lap siding is made of vinyl, aluminum or fiber cement. In the case of extruded siding, the siding panels may have a profile of one or more "boards."

Trees and bushes produce airborne sugars that may drift through the wind and stick to the lap siding. This nearly invisible layer of sugar is a food source for mildew, mold and algae, colonies of which are particularly likely to grow on the shady side of a building. Dust and dirt can also stick to the siding, creating a dull or dirty appearance and serving as a food source for some mildews, molds and algae.

Lap siding is designed to shed water falling from the sky, not water that is shot up into the overlap seam so that power washing may not be a recommended way to clean lap siding. In addition, power washing, without mechanical agitation, may not be totally effective.

Until the present invention, the best way to clean lap siding such as vinyl siding was with a soft brush on a pole, such as sold for cleaning the sides of RVs or windows. The brush is dipped in a cleaning solution and an area of the siding is scrubbed, working from top to bottom or bottom to top, and then rinsed with clear water. One problem with RV type brushes, however, is that the bristles bend around the siding are ineffective at reaching and cleaning the under surface of the lap siding. If this dirt is not removed the siding remains dirty and mildew, mold or algae tends to grow back quickly.

BRIEF SUMMARY OF THE INVENTION

In view of the above, it is an object of the present invention to provide a scrubber for washing lap siding in a manner that both the face and the under surface of the overlapping boards or siding extrusions is reached. It is another object to provide a scrubber for washing lap siding that effectively removes dust and dirt on the under surface of the overlapping boards such that mildew, mold and algae do not quickly recolonize. Other objects and features of the invention will be in part apparent and in part pointed out hereinafter.

In accordance with the invention, a scrubber designed for cleaning lap siding. The scrubber in major part includes an elongated base, a handle and a removable, generally rectangular scrubbing cover or pad. The handle is pivotally connected to the elongated base centrally thereof. In a first embodiment, the elongated base has a bottom surface complementary to the profile of the side and under surfaces of the lap siding. In use a working face of the cover follows the contours of the elongated base. In a second embodiment, the elongated based has a generally flat bottom surface and the pad has a working face complementary to the profile of the side and under surfaces of the lap siding.

For efficiencies in washing, the elongated base preferably has a length such that it overlaps at least a double row of boards. In use, light to moderate forward and upward pressure is applied to the scrubber at an upward angle against the siding to fit the profile of the base or pad to the siding profile being cleaned which causes the cover or the pad to contact the entire siding surface against which the scrubber is pressed.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which:

FIG. 12 is perspective view of the second scrubber with a scrubbing pad in use on extruded dutchlap style vinyl siding; traditionally style lap siding being similar;

DETAILED DESCRIPTION OF THE INVENTION

First Scrubber

Figure 2:
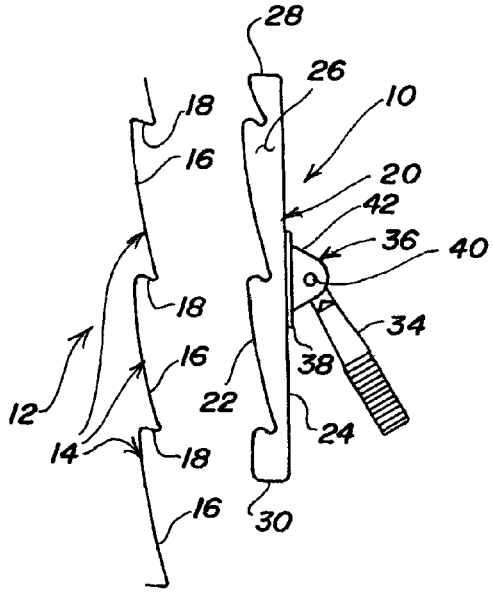
FIG. 2 is a side elevation showing the profile of an extruded vinyl double 5 lap siding and the complementary profile of a bottom surface of the first scrubber.
Figure 3:
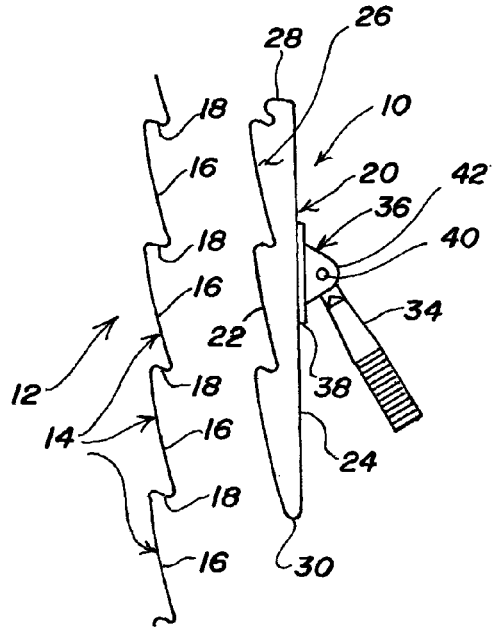
FIG. 3 is a side elevation showing the profile of an extruded vinyl double 4 lap siding and the complementary profile of the elongated base.
Figure 4:
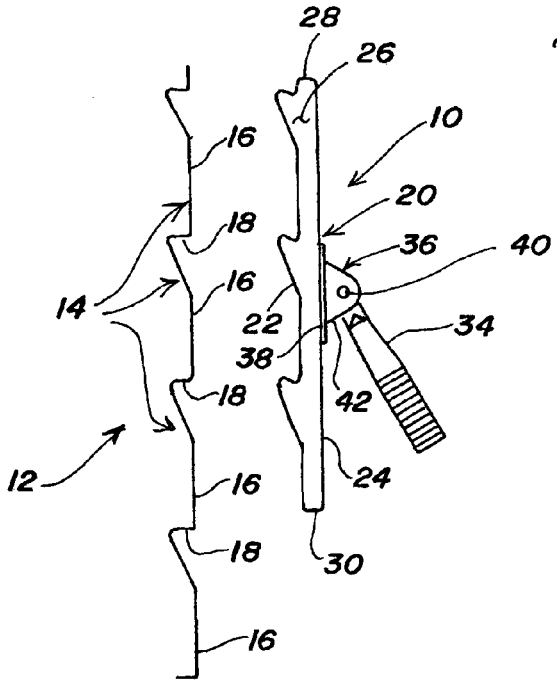
FIG. 4 is a side elevation showing the profile of an extruded vinyl dutchlap double 4.5 siding and the complementary profile of the elongated base.

Referring to the drawings more particularly by reference number, reference numeral 10 refers to a first scrubber adapted to cleaning a lap siding 12. As shown in FIGS. 1-4, lap siding 12 is formed from a plurality of overlapping boards 14 each with a side surface 16 and an under surface 18. Boards 14 may be formed of wood, vinyl, aluminum or fiber cement and may have different profiles. For example, as shown in FIG. 2, the profile is that of Alcoa Silhouette Classic Double 5 lap extruded vinyl siding 12. In FIG. 3, the profile illustrated is Alcoa Silhouette Classic 4 and in FIG. 4 the profile is that of Alcoa Silhouette Classic Dutchlap Double 4.5. The term "double lap" indicates that the extruded siding simulates two boards, while the number (e.g., "5"" in the case of Classic Double 5) refers to the width of each board. While specific profiles are shown in the drawings, it will be understood that scrubber 10 may be adapted to cleaning other lap siding profile 12 and to siding manufactured by other companies.

Figure 10:
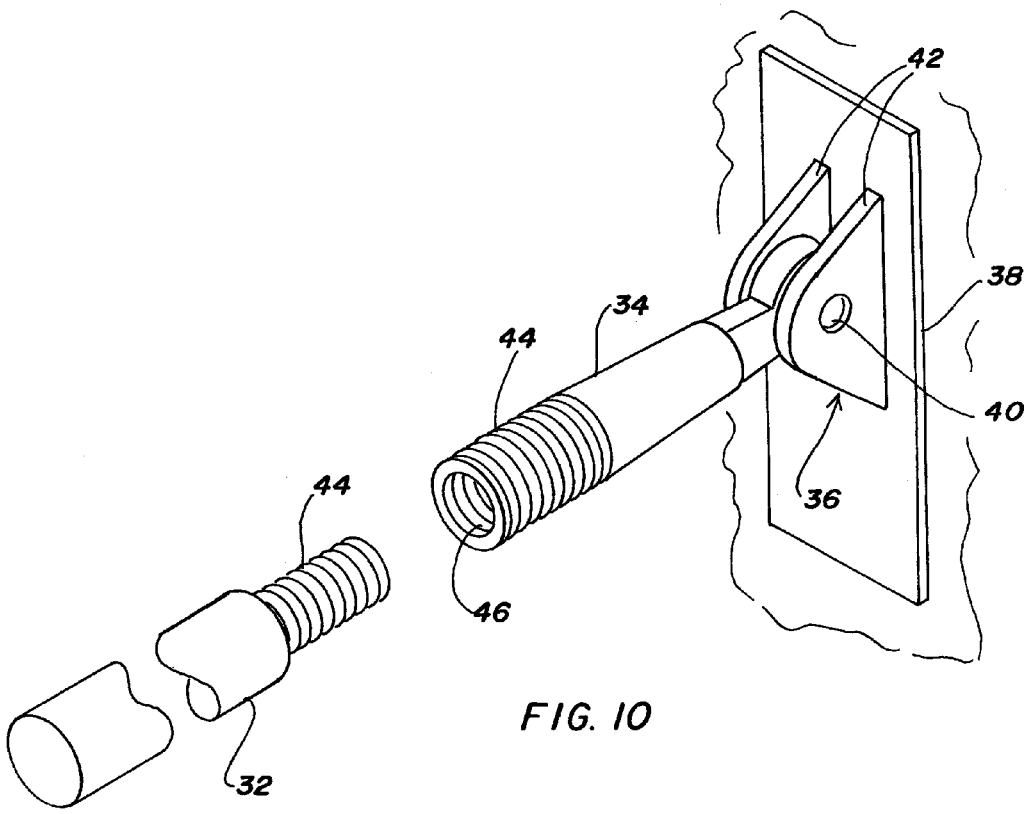
FIG. 10 is a perspective view of a working pole detached from the handle which is pivotally attached to the elongated base.

As best seen in FIGS. 2-5, scrubber 10 includes an elongated base 20 which may be formed of wood, metal or polymer construction such as PVC. Elongated base 20 has a bottom surface 22, a top surface 24, sidewalls 26 and generally blunt upper and lower ends 28, 30 respectively, with side and end edges rounded if desired. As illustrated, elongated base 20 may be about 12-18 inches long and about 1 inch wide such that upper and lower ends 28, 30 of elongated base 20 overlap a double run of lap siding 12 as shown in FIGS. 1-4. Elongated base 20 may be longer such that it overlaps three or more of boards 14 but at some length scrubber 10 may become unwieldy to operate on a pole 32 as shown in FIG. 10. Shorter lengths may also be used.

With continuing reference to FIGS. 1-4, it is seen that bottom surface 22 of elongated base 20 has a profile complementary to the profile of lap siding 12 for full contact with side surface 16 and under surface 18 of boards 14. A handle 34 is pivotally connected to elongated base 20 centrally thereof. As shown in the drawings, pivot 36 is transverse a long axis of elongated base 20 and includes a plate 38 attached to top surface 24 of elongated base 20 with handle 34 pivoted on a pin 40 connecting a pair of ears 42 attached to plate 38. In the form illustrated, plate 38 and ears 42 are integrally molded and attached to elongated base 20 with screws or other conventional fastening means. In some embodiments, pivot 36 and elongated base 20 may be integrally formed. Handle 34 and pivot 36, like elongated base 20, may be formed by cutting or otherwise from wood, metal or polymer such as PVC.

As best seen in FIG. 10, an end of handle 34 opposite pivot 36 may be both male 44 and female 46 threaded for receiving and operably securing a correspondingly threaded male or female threaded end of working pole 32. Pole 32 may be fixed or telescoping and may be of wood, metal or polymer construction. In the embodiment shown in FIG. 10, pole 32 is male threaded 44.

Figure 1:
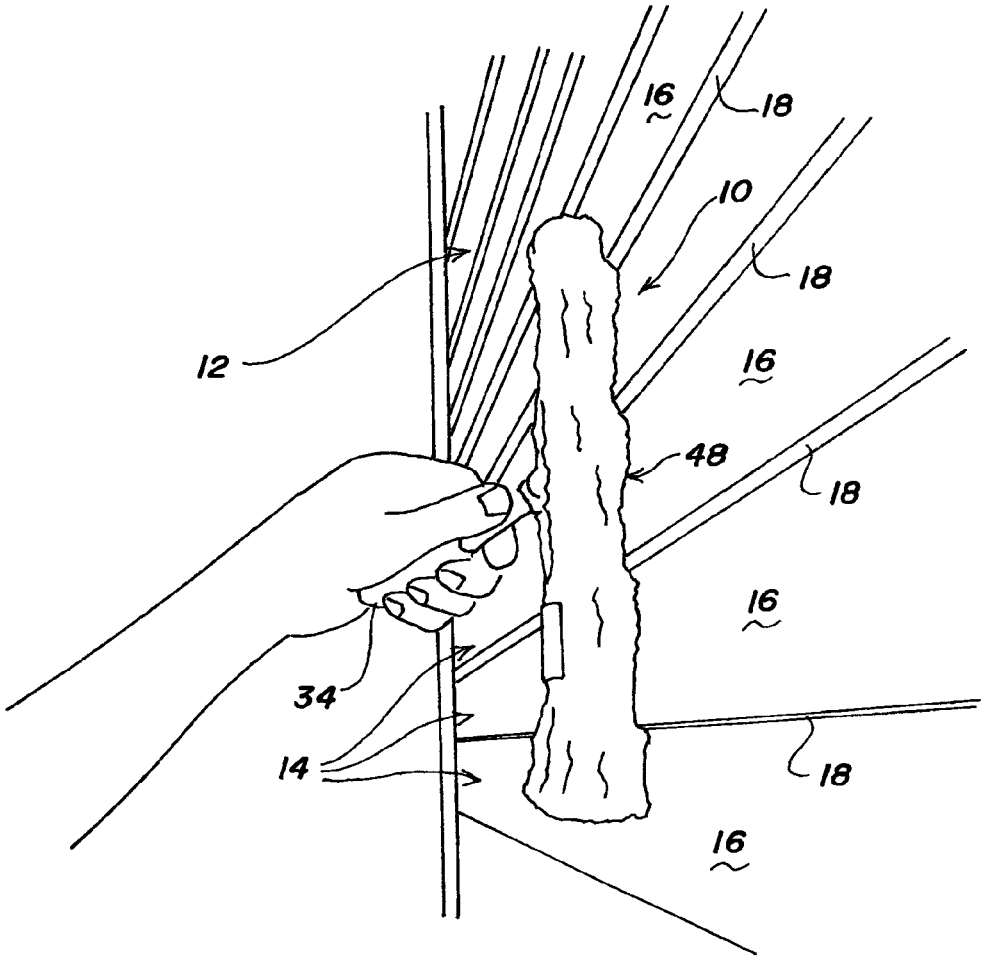
FIG. 1 is a perspective view showing a first scrubber in accordance with the present invention in use cleaning a lap siding.
Figure 5:
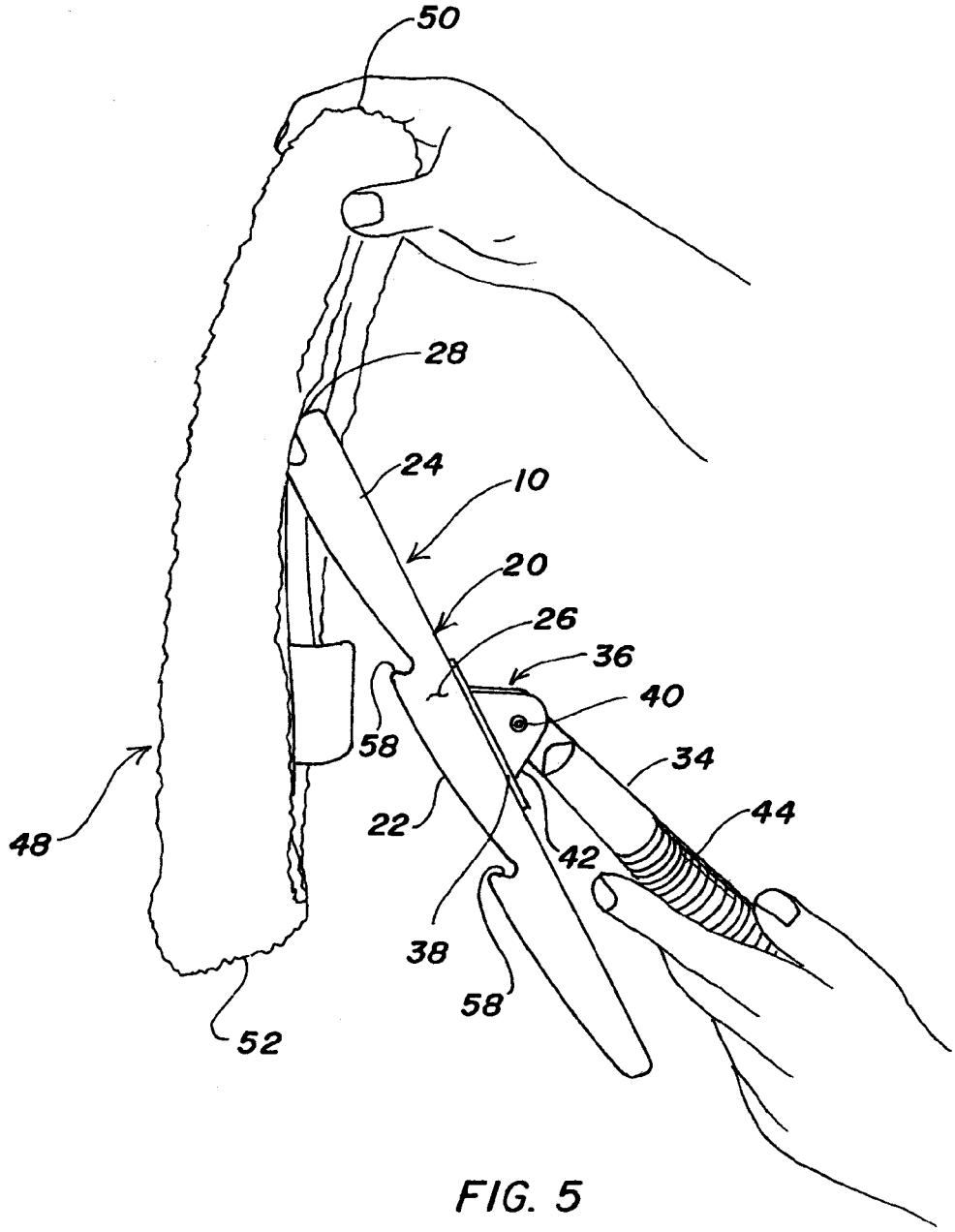
FIG. 5 illustrates the elongated base with a pivotally attached handle being inserted into a cover.
Figure 6:
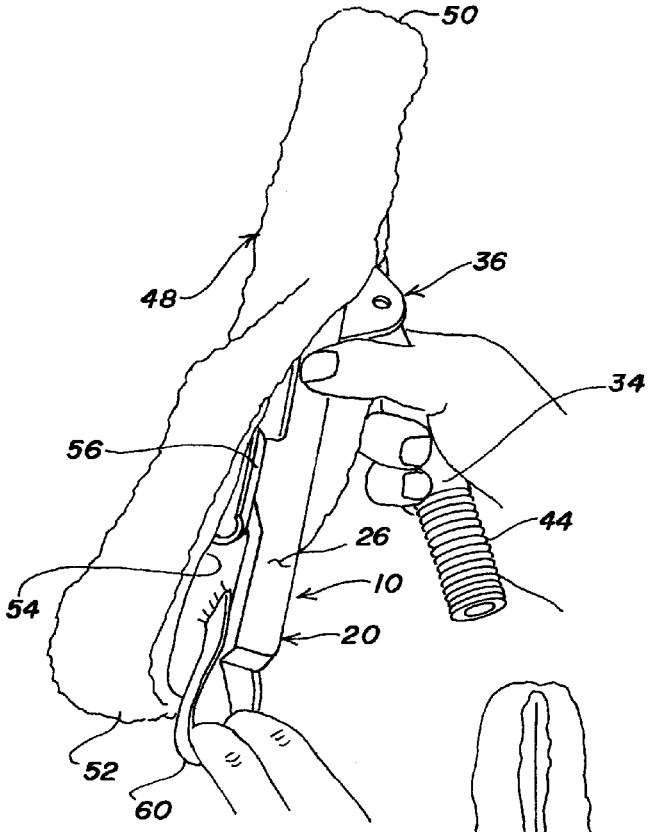
FIG. 6 illustrates an elastic band being secured around a blunt lower end of the elongated base.
Figure 7:
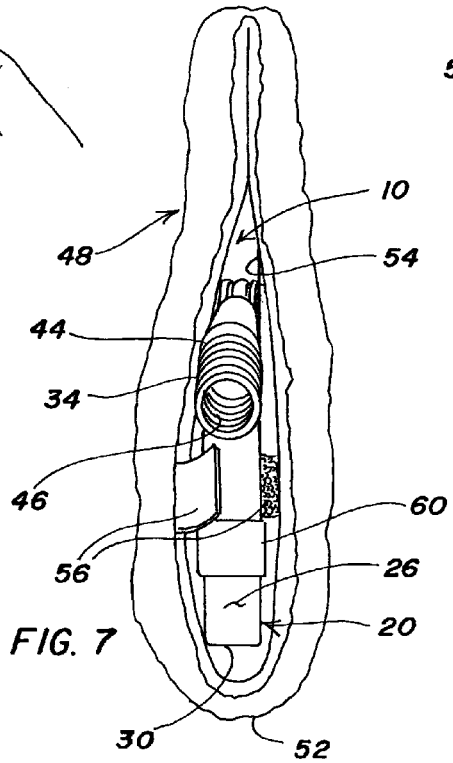
FIG. 7 illustrates the elongated base seated in the cover and secured with the elastic band.
Figure 8:
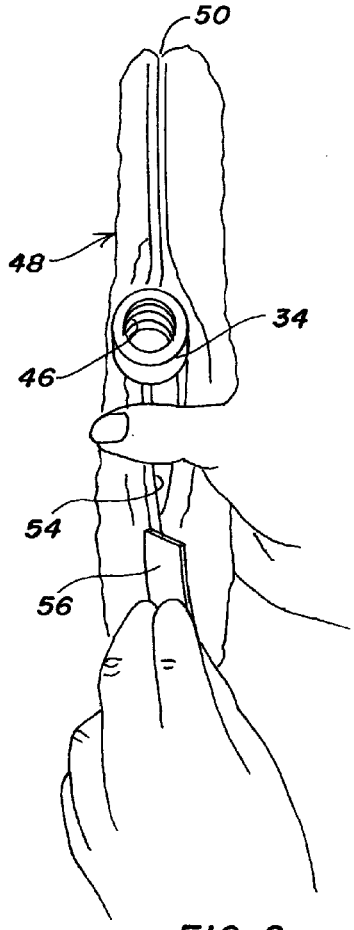
FIG. 8 illustrates a closure means for closing the cover over the elongated base.
Figure 9:
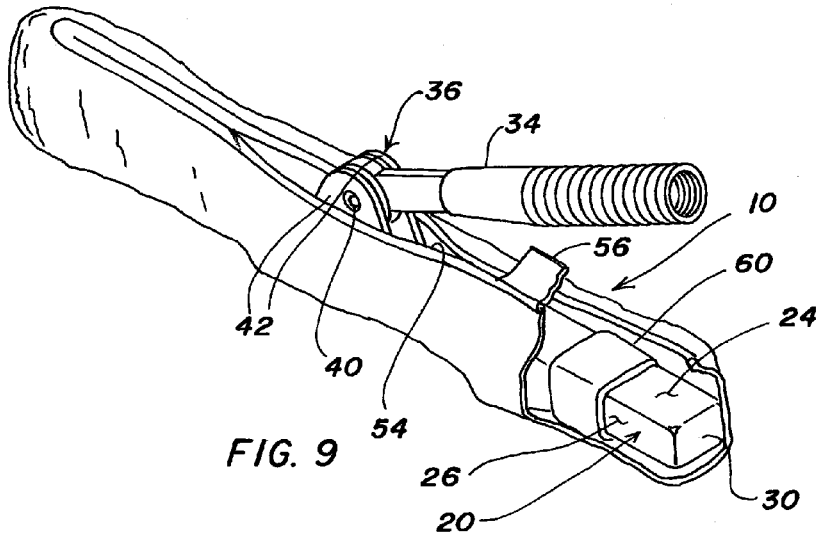
FIG. 9 is a perspective view of the elongated base in the cover with the cover partially broken away to show the elastic band for latching the elongated base securely in the cover.

A generally rectangular cover 48 shown in FIG. 1 is removable mounted on elongated base 20 as shown in FIGS. 5-9. Cover 48 comprises an integral fold of cover material with the fold positioned under bottom surface 22 of elongated base 20. The material used for cover 48 may be a micro fiber fleece on a mesh backing such as used for window scrubbers, terry cloth, chamois, or the like. Cover material preferably has a nubby or otherwise textured surface and sponge-like characteristics for more effective cleaning of lap siding 12. Cover 48 has first and second side edges 50, 52 extending between the fold and top surface 24 of elongated base 20. First and second side edges 50, 52 are permanently secured together by fusing, with stitches or the like. Cover 48 forms an envelope with an opening 54 along an edge opposite the fold to permit installation and removal of cover 48 as illustrated in a sequence of steps illustrated in FIGS. 5 though 9. Opening 54 is permanently secured together as shown in FIGS. 7-9 between first side edge 50 and handle 34 by fusing, with stitches or the like. A closure means 56 such as hook and pile fabric (e.g., VELCRO), snaps, hooks or other conventional fasteners may be used for closing the envelope about elongated base 20.

As shown in FIG. 5, blunt upper end 28 of elongated base 20 with teeth 58 on bottom surface 22 upwardly directed is inserted in cover 48 under closed end of opening 54. An elastic band 60 (FIGS. 6-7 and 9) may be provided on the inside of cover 48 below closure means 56 into which blunt lower end 30 of elongated base 20 may be slipped as shown in FIG. 6. With elongated base 20 seated in envelope, male and female mating members (i.e., hook and pile VELCRO closure means 56) may be deployed as shown in FIGS. 7 and 8 to close envelope about elongated base 20 with elongated base 20 securely lashed within the envelope under elastic band 60.

Prior to using scrubber 10, lap siding 12 should be wetted down with a regular garden hose equipped with a nozzle. It is desirable to set the nozzle to a medium misting spray such that water is not driven behind the siding, particularly in the case of vinyl siding which may not be backed with a waterproof membrane. Scrubber 10 may then be wetted by dipping it into a bucket of cleaning solution.

Starting from the top, a section of lap siding 12 is worked, moving scrubber 10 from side to side at a steady pace. As seen in FIG. 1, cover 48 conforms to elongated base 20 whose flat bottom surface 22 is complementary to side and under surfaces 16, 18 of lap siding 12 such that dirt, mildew, mold and algae are loosened from all the surfaces. Before the cleaning solution dries on the siding, the area just worked is rinsed with clear water. Work is then continued until the bottom of the wall is reached, alternately scrubbing and rinsing with clear water all the way down to prevent streaks.

Another section of lap siding 12 is then preliminarily wetted with water and the process repeated until the entire area to be cleaned has been scrubbed.

Second Scrubber

Turning now to FIGS. 11-14, second scrubber 62 has a flat backing plate 64 and a handle 66 pivotably connected to the backing plate. Backing plate 64 has a bottom surface 68 and a top surface 70 and is preferably sized in length such that it overlaps a double run of lap siding 12. Backing plate 64 may be longer such that it overlaps three or more boards 14 (as with triple 3 vinyl siding) but at some length it may become unwieldy to operate. In other instances where boards 14 have six to seven inch laps, backing plate 64 may be sized to cover only side surface 16 plus under surface 18 of an upper board. As illustrated, but not limited thereby, backing plate 64 is about 3½ inches wide and 9 to 10 inches long.

Figure 11:
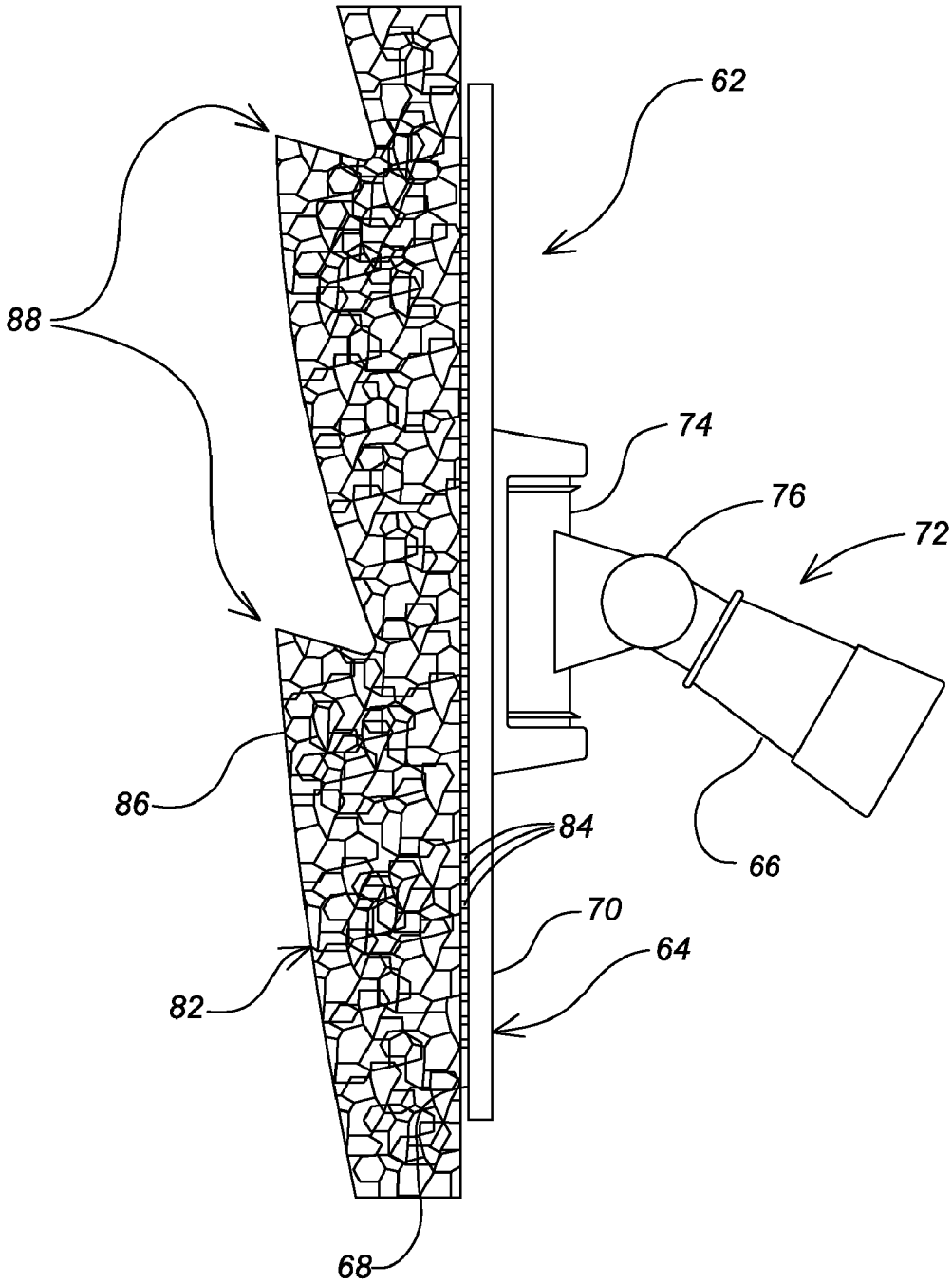
FIG. 11 is a side elevation of a second scrubber in accordance with the present invention.
Figure 14:
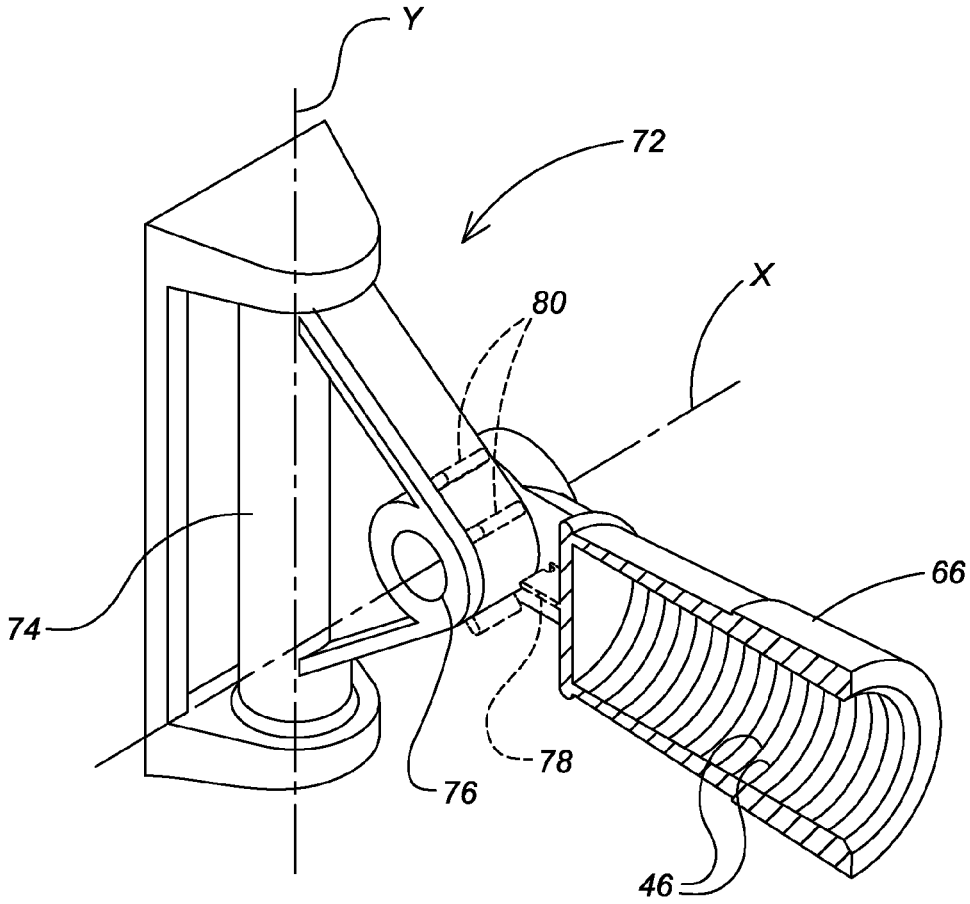

As best seen in FIGS. 11 and 14, a double swivel joint assembly 72 is attached to top surface 70 of backing plate 64. Double swivel joint assembly 72 has a vertical swivel joint 74 and a horizontal swivel joint 76. Vertical swivel joint 74 allows rotation of backing plate 64 about axis Y from side to side and horizontal swivel joint 76 allows rotation of backing plate 64 about axis X up and down. Double swivel joint assembly 72 may be provided with female threads 46 to fit any standard threaded pole and/or male threads (not shown). Horizontal swivel joint 76 may be restricted from moving freely, which may be done by friction, spring-loaded tabs in slots, or as shown, by a spring biased tongue 78 and ridges 80 for holding the pivot in a selected position and permitting a user to easily change the pivot position to the next ridge 80 or position. With other commercially available double swivel joint assemblies 72 no special provision is made for restricting either of swivel joints 74, 76.

Figure 13A:
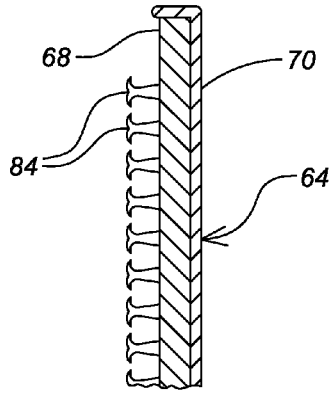
FIG. 13A is a cross-section on an enlarged scale, partially broken away and taken along the plane of 13A-13A in FIG. 13; and, FIG. 14 is a side elevation partially in section showing a two-way pivot joint for attachment of a pole.
Figure 13:
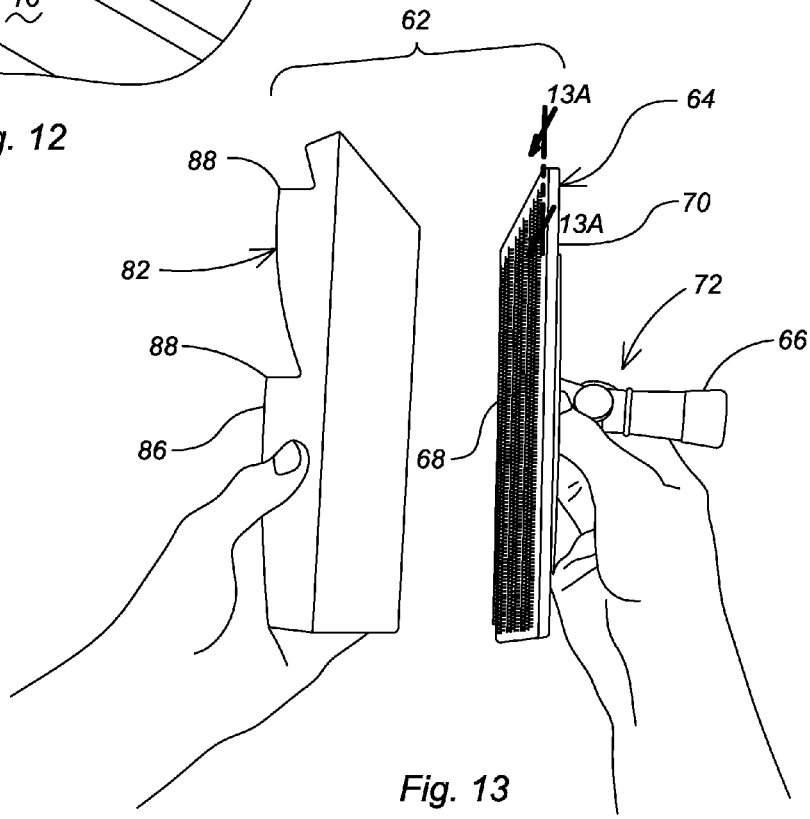
FIG. 13 is a perspective view illustrating the scrubbing pad separated from the elongated base to which it is attached.

A scrubbing pad 82 is attached to bottom surface 68 of backing plate 64. As shown in FIG. 13, bottom surface 68 may include a plurality of fingers or barbs 84 which are designed to latch into scrubbing pad 82. Additionally or alternatively, slides, clips, elastic string and other attachments may be employed to releasably secure scrubbing pad 82 to bottom surface 68 of backing plate 64. Fingers or barbs 84 may be integrally formed with backing plate 64 or separately formed and attached thereto.

Scrubbing pad 82 is formed of an open cell natural or synthetic sponge rubber that keeps its shape and is not affected by cleaners or bleach. Closed cell sponge materials are not preferred because they tend to suction attach to side surface 16 of lap siding 12. One suitable reticulated open cell sponge is formed from polyester. Other types of open cell synthetic rubber sponges may be used including those formed from butyl, urethane, vinyl and so forth. With polyester open cell sponge, larger open cells create more friction/drag than small cells. Too small cells, however, may not provide an aggressive enough scrubbing action. A balance between drag and abrasiveness with open cell sponges has been found when the cell count is between about 2 and 25 ppi (pores per linear inch), more preferably between about 8 and 20 ppi. In the case of open cell polyester sponges in particular, very good results have been obtained when the cell count was between about 12 and 18 ppi.

Figure 12:
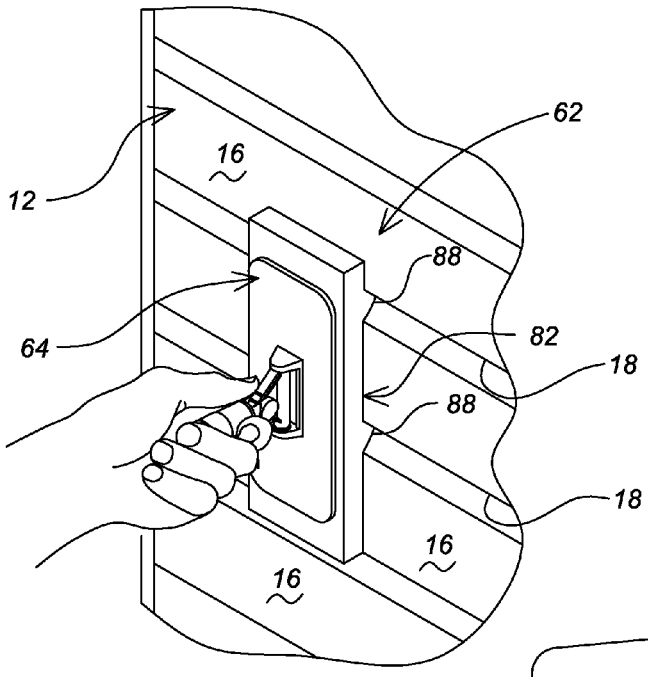

As shown in FIGS. 11-12, scrubbing pad 82 has a bottom surface 86 that conforms to the profile of lap siding 12. As illustrated, scrubbing pad 82 is about ¾ to 1½ inches thick at its thickest point depending on lap depth. On boards 14 with a rougher textured surface, scrubbing pad 82 may need to be thinner to compensate for the overturning moment on the pad. As a rule of thumb, good results are obtained when scrubbing pad 82 is about ⅝ to ½ inch thicker than under surface 18.

With continuing reference to FIG. 11, it is seen that a plurality of projections or wiping fingers 88 on bottom surface 86 are angled upwardly. This is compensates for differences in the depth of under surface 18 between siding manufacturers or brands. Projections 88 preferably have a length such that a tip end of the projection contacts the maximum expected depth of under surface 18 and a root end of the projection is the minimum expected depth. Thus when scrubbing pad 82 is formed of a compressive open cell sponge, under surface 18 of lap siding 12 is cleaned, irrespective of the depth of lap.

In use, second scrubber 62 may be used without attachment to a pole for low areas that can be reached by holding the scrubber by handle 66. With a pole attached, a user can clean up to a 10 foot wide area from one position due to the two-way action of double swivel joint assembly 72. Scrubbing pad 82 has very little absorbent properties. It is therefore recommended that lap siding 12 be prewetted with cleaning solution with a garden sprayer or hose with a cleaning solution attachment prior to scrubbing with scrubber 62.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A scrubber comprising an elongated base, a handle and a removable, generally rectangular cover, said handle pivotally connected to said elongated base centrally thereof, said elongated base having a generally flat bottom surface complementary to the profile of a lap siding formed of a plurality of overlapping rows of boards having side and under surfaces, said cover removably mounted on said elongated base, said cover comprising an integral fold of cover material with said fold positioned under the bottom surface of the elongated base, said cover having first and second side edges extending between the fold and a top surface of the elongated base and being permanently secured together, said cover defining an envelope and having an opening along an edge opposite the fold to permit removal of said cover from said elongated base, said opening being permanently secured together between the first of said side edges and the handle and said opening having a closure means between the second of said side edges and the handle for closing said envelope about said elongated base.

2. The scrubber of claim 1 wherein an elastic band is provided on the inside of the cover below the closure means to secure the elongated base in the cover.

3. The scrubber of claim 1 wherein the elongated base overlaps at least two rows of boards in the lap siding.

4. The scrubber of claim 1 wherein the cover is formed of a material having a textured surface and sponge-like characteristics.

5. A scrubber comprising an elongated base, a handle and a removable, generally rectangular cover, said handle connected by a pivot to said elongated base centrally thereof, said pivot comprising a pin upon which the handle is pivoted, said pin supported between a pair of ears attached to a plate that is mounted on the elongated base, said elongated base having a generally flat bottom surface complementary to the profile of a lap siding formed of a plurality of overlapping rows of boards having side and under surfaces, said cover removably mounted on said elongated base, said cover comprising an integral fold of cover material with said fold positioned under the bottom surface of the elongated base, said cover having first and second side edges extending between the fold and a top surface of the elongated base and being permanently secured together, said cover defining an envelope and having an opening along an edge opposite the fold to permit removal of said cover from said elongated base, said opening being permanently secured together between the first of said side edges and the handle and said opening having a closure means between the second of said side edges and the handle for closing said envelope about said elongated base.

6. The scrubber of claim 5 wherein an elastic band is provided on the inside of the cover below the closure means to secure the elongated base in the cover.

7. The scrubber of claim 5 wherein the elongated base overlaps at least two rows of boards in the lap siding.

8. The scrubber of claim 5 wherein the cover is formed of a material having a textured surface and sponge-like characteristics.

9. A scrubber comprising a flat backing plate with a removable scrubbing pad and a handle, said handle pivotally connected with a double swivel joint assembly to the flat backing plate, said scrubbing pad having a bottom surface complementary to the profile of a lap siding formed of a plurality of overlapping rows of boards having side and under surfaces, said bottom surface having upwardly directed projections with a tip end of the projections contacting the maximum expected depth of the under surface and a root end contacting the minimum expected depth, said scrubbing pad formed of an open cell synthetic sponge.

10. The scrubber of claim 9 wherein the scrubbing pad is detachably attached to a bottom surface of the flat backing plate with a plurality of barbs.

11. The scrubber of claim 9 wherein the scrubbing pad is formed of a reticulated open cell synthetic sponge.

12. The scrubber of claim 9 wherein the scrubbing pad is formed of a reticulated open cell polyester sponge.

13. The scrubber of claim 12 wherein the open cell sponge has a cell count between about 2 and 25 ppi.

14. The scrubber of claim 12 wherein the open cell polyester sponge has a cell count between about 12 and 18 ppi.

15. The scrubber of claim 12 wherein the scrubbing pad has a maximum thickness of about 5/16 to 1/2 inch more than the depth of the under surface to reduce a turning moment on the scrubbing pad.

* * * * *